US005324131A

United States Patent [19]

Gardner, III

[11] Patent Number: 5,324,131

[45] Date of Patent: Jun. 28, 1994

[54] EMPHASIZING INK REMOVING APPLICATOR AND INK REMOVAL METHOD

[76] Inventor: William G. Gardner, III, 165 Old State Rd., Erving, Mass. 01344

[21] Appl. No.: 243,051

[22] Filed: Sep. 9, 1988

[51] Int. Cl.[5] ..... B43K 5/00

[52] U.S. Cl. ..... 401/199

[58] Field of Search ..... 401/17, 18; 106/19-23

[56] References Cited

U.S. PATENT DOCUMENTS 3,859,044 1/1975 Blomfield ..... 8/142
3,941,488 3/1976 Maxwell ..... 401/17
4,681,471 7/1987 Hayduchok et al. .

*Primary Examiner*—David Isabella
*Attorney, Agent, or Firm*—Richard P. Crowley

[57] ABSTRACT

An applicator for eradicating or removing transparent or translucent emphasizing inks, particularly from a paper surface, wherein the emphasizing ink has been used over permanent ink or a printed surface to emphasize such surface or an area and which applicator comprises a container, a liquid bleaching agent in the container for the emphasizing ink and means on one end of the container, such as a felt tip or roller, to apply a thin film of the liquid bleaching agent to the emphasizing ink and to effect the eradication or removal thereof without substantially affecting the removal or eradication of the underlying ink or printed material which has been emphasized. A method of eradicating transparent ink markings from a surface, such as a paper surface, which method comprises applying a liquid bleaching agent over the ink marked portion of the surface to be eradicated to chemically bleach and eradicate the ink material so marked without substantially affecting any printed ink or print on the underlying surface.

5 Claims, 1 Drawing Sheet

EMPHASIZING INK REMOVING APPLICATOR AND INK REMOVAL METHOD

BACKGROUND OF THE INVENTION

Many brand names and varieties of markers exist for the purpose of emphasizing printed or written material and to designate particular areas on paper surfaces. For example, one such commercial type of marker is produced by Carter's Ink Company and is known by the trade name HIGHLIGHTER ®.

Typically, these emphasizing markers use pastel or fluorescent shades of transparent or translucent inks or dyes which are water-based and non-pigmented. Such highlighting inks and dyes are generally applied by rubbing a liquid saturated felt tipped applicator across or around the paper surface which is to be emphasized and generally over the permanent type of ink marking to be emphasized. The paper surfaces typically are photocopies, books, drawings, newsprint, documents or other similar papers having rather permanent type ink or print thereon.

Highlighting is so easy to apply that it is often overused, mistakes are easy to make and most unfortunately many of the colors reproduce as gray shaded areas on photocopies of highlighted surfaces. It is therefore highly desirable to provide a means to erase, eradicate or otherwise remove the emphasizing inks or dyes from paper or other surfaces with little or no affect to the underlying printed, written or photocopied text and without substantial damage to the paper or other surfaces.

SUMMARY OF THE INVENTION

This invention relates to an emphasizing ink removal applicator, a kit containing the applicator and a method of using the applicator and kit so as to erase, eradicate or remove certain types of inks or dyes from paper surfaces without substantially affecting the underlying printing, writing or underlying surface. It has been discovered that transparent or translucent, pastel or fluorescent, water-based, non-pigmented inks or dyes (commonly used to emphasize or highlight areas on paper surfaces and called emphasizing inks) can be erased, eradicated or essentially removed by the application of a thin film of a liquid bleaching agent.

It has also been discovered that the bleaching agent does not substantially affect the more permanent types of inks (thermosetting, cured resin, pigment-type, india ink or non-aqueous inks) which are not used for highlighting, but rather are used for textbooks, printing or photocopying. The bleaching agent also does not produce any significant affect on most ballpoint pen inks although it can lighten or almost remove some of the more exotic colors, and some water-based ball pen inks. It has further been discovered that the application of the thin film of bleaching agent does not require blotting and does not significantly affect most paper surfaces (some papers pucker slightly). These three concepts used in concert permit the selective removal of emphasizing inks from more permanent inks while inflicting little or no damage to the underlying paper. In fact, the removal, erasing, eradicating, etc. of the emphasizing ink restores the text, document, etc. to nearly its original condition, thus allowing photocopying or re-emphasizing in the proper places.

The application of the liquid bleaching agent to the ink being removed may be accomplished by a number of techniques, methods and containers containing the bleaching agent.

The bleaching agent may be applied to a variety of surfaces whether plastic, paper, some synthetic fabrics or the like (should not be used on silk, rayon or wool). However, it is particularly useful and effective when the underlying surface is paper. The aqueous bleaching agent might produce a slight puckering to some papers, but upon drying, the papers normally would not be further affected by the bleaching solution.

The bleaching agent is typically applied in a think film by one of two ways. First, by an open cell applicator, such as a cotton or felt tip or an open sponge material, saturated with the liquid bleaching solution rubbed directly against the surface that is highlighted. This means of applying the liquid bleaching agent would include those fibrous, open-celled materials, which will not be dissolved or affected by the bleaching solution, such as a resin-impregnated felt material, as well as open-celled polyvinyl chloride or urethane-type foam all of which are flexible, soft and permit the application of a thin film. In this embodiment, the liquid bleaching agent is applied with an applicator containing the solution wherein the felt tip or open-celled foam applicator at one end of the container is saturated by direct contact with the liquid bleaching agent in the container and is applied as desired in a thin film by lightly rubbing the felt or foam saturated tip along the surface where the ink is to be removed.

In the other embodiment, the thin film can be applied by means of a roller made of a ceramic, nylon or other synthetic material which will not be affected by the bleaching solution. The roller should be at one end of the container of bleaching solution in such a way that approximately one-half of the roller is in contact with the bleach and the other half is accessible so as to be rolled across the surface being bleached. This alternative means of application may be more gentle with the paper surface than the open-celled tip would be since its use does not result in rubbing the surface.

In yet another embodiment, it is optionally desired to employ a method of neutralizing or otherwise rendering ineffective the liquid bleaching agent after such agent has accomplished its bleaching function. This is an optional feature of the invention, and a variety of bleach killing agents may be employed as desired, for example, aqueous solutions of thiosulfate, such as sodium thiosulfate. This liquid bleach neutralizing agent is not particularly needed on most paper materials, but could be useful when the underlying material may be affected by the liquid bleaching agent. In some cases the neutralizing agent may prevent unwanted effects to the underlying material if the liquid bleaching agent is overused or contains too strong a concentration for that particular type of underlying ink or surface. For example, selective removal of highlighting from an unusual color of ballpoint pen ink on an exotic writing surface may require neutralizing the bleach as soon as it has erased the highlighting so as not to affect the underlying material.

The invention also comprises the employment in combination of an ink emphasizing marker and an unmarker kit wherein the kit would comprise the usual commercially available available felt tipped markers containing highlighting or emphasizing ink material in various colors as required, as well as the combination of an ink eradication unmarker in the kit particularly designed to eradicate that ink (which unmarker would comprise a liquid bleaching agent in a container and optionally a bleach killing or neutralizing agent in a separate container). In this manner, the unmarker applicator may be particularly adapted in concentration and selection of the particular bleaching agent to be rapidly and especially effective in removing, erasing or eradicating the highlighting material in a particular kit.

A wide variety of liquid bleaching agents and concentrations may be employed in the practice of the invention for erasing the transparent inks used to emphasize printing or writing. It has been discovered that halogen-containing liquid bleaching solutions are particularly effective. In particular, hypochlorite-type or triazine chlorine or triazine-type derivative solutions are desirable. More particularly, it has been discovered that 5.25% and 12.5% sodium hypochlorite solutions as well as calcium hypochlorite solutions and chlorine triazinetrione solutions, such as trichloro-s-triazinetrione solutions, are particularly desirable for removing highlighting ink from paper sheets without affecting the underlying printed material. The type of bleaching agent and the concentration employed may vary as desired against any particular transparent ink to be removed and particularly in the selection of kit components for which the bleaching agent and the bleach neutralizing agent should be matched to the particular translucent ink employed in the kit.

The halogen bleaching agents work well on a wide variety of highlighting ink, flair-type pens, and some felt tipped markers. For example, it has been found that translucent highlighter inks were removed almost completely for every type and color of highlighter ink presently and generally widely commercially available and that the bleaching agent worked, but not quite as well, on most of the colors of the flair-type, fine point, fiber-tipped marking pens which may be used for emphasizing. It has been found that some of the flair-type inks to be removed required several applications of the bleaching agent, and in a small number of cases, some inks left a lightly visible mark. The bleaching agent has been found to remove some computer printing, blue lines on some pad paper and to bleach the color from a variety of colored papers, so care should be employed in using a colored paper substrate.

In summary, a 5.25% solution and 12.5% of sodium hypochlorite, a saturated solution of trichloro-s-triazinetrione and a saturated solution of calcium hypochlorite have been discovered to be particularly effective in ink removing applicators. However, it has been discovered that a 3% solution of hydrogen peroxide, a 6% solution of hydrogen peroxide, and a 6% solution of hydrogen peroxide with ammonia added (hair bleaching solution) are not effective. Thus, it appears that chlorine-type, oxidizing bleaching solutions work particularly well against the transparent highlighting ink composition to be removed, while peroxide-type solutions are not similarly effective.

The invention will be described for the purposes of illustration only in connection with certain embodiments; however, it is recognized that those persons skilled in the art may make various changes, additions, modifications and improvements to the embodiments so described, but all falling within the spirit and scope of the invention.

BRIEF DESCRIPTION OF THE DRAWINGS

FIG. 3 is the printed material after removal of the highlighting ink section.

DESCRIPTION OF THE EMBODIMENTS

Figure 1:
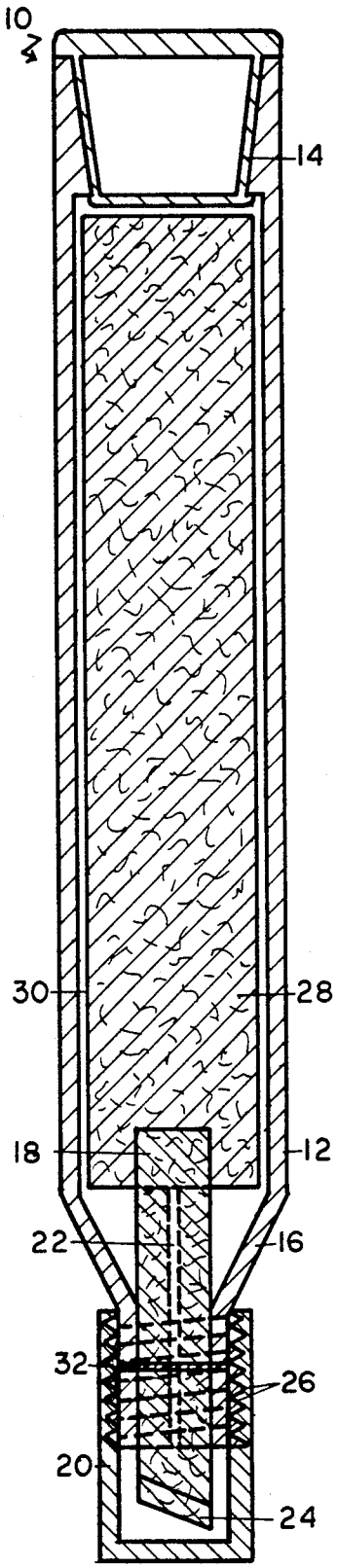
FIG. 1 is an illustrative, schematic, cross sectional view of a highlighting ink removing applicator useful in the invention and of the invention.

FIG. 1 is an illustrative, schematic, cross sectional view of a highlighting removing applicator 10 which comprises an elongated plastic container 12 having a push-in filler cap which airtight at the one end 14, a tapered section 16 at the other end, the tapered section containing a resin-impregnated round wick which is tightly fitted into the tapered section 16, the round wick so as not to be effected by the bleaching agent solution or the neutralizing solution, whichever is employed, in the container 12, the one end of the container 12 containing an airtight screw cap 20 about the screw threads 26 and the resin-impregnated round wick 18 having a chisel-type tip 24 for the application of a thin film of the solution from the container 12 onto the translucent ink on a paper sheet. Within the container 12 is a batting-type material 28 designed to hold a liquid bleaching solution 30 to be applied to the translucent ink, such as a sodium hypochlorite solution, wherein the cotton batting is formed in a plastic sheath 30, for example, 1 to 2 mils in thickness. The cotton batting 28 saturated with the liquid solution 30 is in a liquid saturating relationship with the resin-impregnated round wick 18 so that the chisel tip of the wick 24 is saturated with the liquid bleaching solution 30. The one end of the container 12 contains a slight air channel 22 in one side of the extended container to permit the evacuation of air while the resin-impregnated round wick is retained in position through the employment of a plastic pin 32, such as nylon pin, extending through the wick and securing the wick 18 within the tapered section 16 of the container 12 and which nylon pin 32 extends totally through the wick 18.

The described applicator may be filled either with a bleaching solution or the aqueous, bleach neutralizing solution to be applied from the container or containers, an eradicator applicator and a neutralizing applicator may be employed alone or in combination with other ink highlighting markers. The bleaching and neutralizing applicators may not necessarily be an aqueous solution, but may be an alcohol-aqueous solution or another type of solution. Typically, the bleaching agent and neutralizing agent may contain other solvents or diluents or other additives, such as propylene, ethylene glycol or alcohol, such as isopropynol or other type materials, as well as additives such as stabilizers, bleach stabilizing additives and other materials which may be employed to accomplish the bleaching of the ink.

Figure 2:
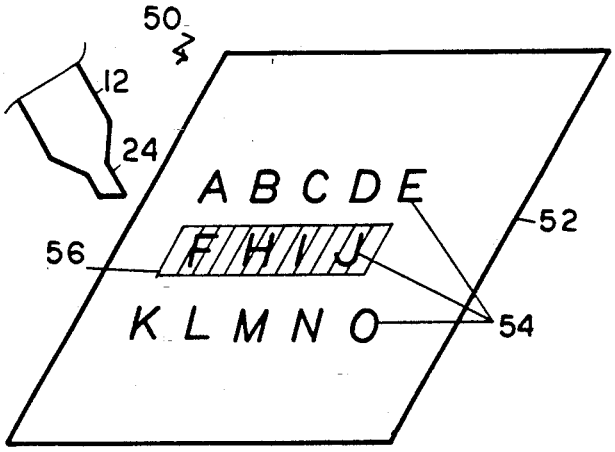
FIGS. 2 and 3 are an illustrative, schematic view of a printed sheet material containing a translucent highlighter ink in FIG. 2.
Figure 3:
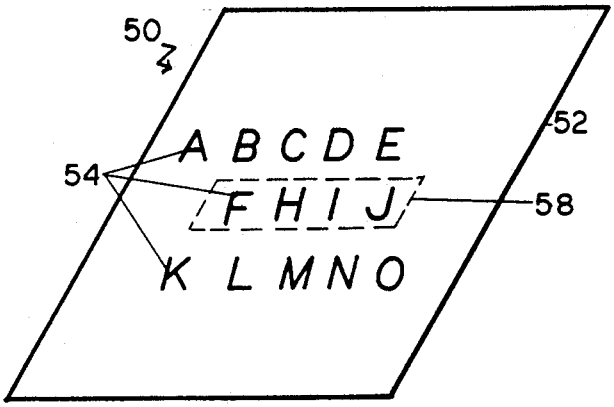

FIGS. 2 and 3 are a schematic illustration of the use of the applicator 10 of FIG. 1 in connection with the removal of a transparent highlighting ink from a printed page wherein the applicator is illustrated as the container 12 with a chisel tip 24 to dispense a thin liquid film of liquid bleaching agent to a document system 50 comprising a paper sheet 52 on which for illustration only is printed letters of the alphabet 54 with certain portions F-H-I-J shown as being highlighted by a transparent, water-based, non-pigmented ink which has been dried 56 on surface. The felt tip 24 containing the liquid saturating bleaching agent solution is then applied over the F-H-I-J portion of the dried translucent ink 56, and the results are illustrated in FIG. 3 wherein it is shown that the translucent ink 56 has been removed without affecting the underlying printed words 54 and the paper sheet 52, the removal area 58 blended into the paper area 52 as to be substantially not noticed, and the underlying printed material 54 and the paper 52 not visibly affected by the bleaching solution.

Therefore, the invention provides a means for employing one or more applicators containing an ink bleaching solution and optionally a bleach neutralizing solution and a method of erasing or eradicating transparent emphasizing ink from a surface, typically a printed page containing other printed material which is not affected by the bleaching solution.

What is claimed is:

1. The method of eradicating transparent or translucent, non-pigmented, water-based emphasizing ink markings from a paper surface containing non-bleachable, more permanent ink or print material, which method comprises:

a) applying a sufficient amount of a thin film of a hypochlorite or chlorine liquid bleaching agent on the emphasizing ink markings placed over the underlying, more permanent ink or print material, the underlying, non-bleachable, more permanent ink or print material not affected substantially by said liquid bleaching agent, and wherein the emphasizing ink markings have been employed to emphasize at least a portion of the more permanent ink or print material on the paper surface and to bleach chemically and to eradicate substantially the emphasizing ink markings without substantially affecting the underlying ink or print material or the paper surface; and b) applying subsequently a thin film of a liquid neutralizing agent to the surface areas which the liquid bleaching agent has been applied to neutralize the action of the liquid bleaching agent after eradication of the emphasizing ink markings.

2. The method of claim 1 wherein the liquid bleaching agent is trichloro-s-triazinetrione.

3. The method of claim 1 wherein the liquid neutralizing agent comprises a liquid thiosulfate solution.

4. The method of claim 1 which includes applying a thin film of the liquid neutralizing agent by a soft, flexible, open cell foam or fibrous material.

5. The method of claim 1 which includes applying a thin film of the liquid bleaching agent by use of a roller in contact with the liquid bleaching agent.

* * * * *